US012312756B2

(12) United States Patent
Jang

(10) Patent No.: US 12,312,756 B2
(45) Date of Patent: May 27, 2025

(54) BOLLARD FOR FLOOR INSTALLATION

(71) Applicant: Jeong Eun Jang, Seoul (KR)

(72) Inventor: Jeong Eun Jang, Seoul (KR)

( * ) Notice: Subject to any disclaimer, the term of this patent is extended or adjusted under 35 U.S.C. 154(b) by 248 days.

(21) Appl. No.: 18/131,909

(22) Filed: Apr. 7, 2023

(65) Prior Publication Data

US 2024/0318391 A1 Sep. 26, 2024

(30) Foreign Application Priority Data

Mar. 21, 2023 (KR) ..... 10-2023-0036239

(51) Int. Cl.
*E01F 15/00* (2006.01)
*E01F 15/14* (2006.01)

(52) U.S. Cl.
CPC ..... *E01F 15/003* (2013.01); *E01F 15/14* (2013.01)

(58) Field of Classification Search
CPC . E01F 9/623; E01F 9/627; E01F 9/629; E01F 15/003; E01F 15/14
USPC ..... 40/608
See application file for complete search history.

(56) References Cited

U.S. PATENT DOCUMENTS 4,491,438 A * 1/1985 Berutti ..... A63C 19/062 40/608
5,500,642 A * 3/1996 Battle ..... E01F 9/629 40/608
5,597,262 A * 1/1997 Beavers ..... E01F 9/627 116/63 P
7,377,717 B2 * 5/2008 Clark ..... E01F 9/629 40/608
11,136,735 B2 * 10/2021 Parrott ..... E01F 9/681
2005/0076552 A1 * 4/2005 Tolna ..... G09F 15/0056 40/608
2006/0099030 A1 * 5/2006 Yamasaki ..... E01F 15/143 404/6
2018/0010308 A1 * 1/2018 Mandal ..... E01F 9/631

FOREIGN PATENT DOCUMENTS

DE 2037618 A1 * 2/1972
KR 101838228 B1 * 4/2018
WO WO-2013187847 A2 * 12/2013 ..... E01F 9/629

* cited by examiner

*Primary Examiner* — Christine T Cajilig
(74) *Attorney, Agent, or Firm* — IPLA P.A.

(57) ABSTRACT

A bollard for floor installation that includes: a base that is installed on the ground; an intermediate outer cylinder that is installed on the top of the base; a connector that is fitted in the base through the internal space of the intermediate outer cylinder; a spring that is fitted on the connector; and an extension outer container that extends a length by being coupled to the intermediate outer cylinder.

4 Claims, 4 Drawing Sheets

BOLLARD FOR FLOOR INSTALLATION

CROSS-REFERENCE

This application claims under 35 U.S.C. § 119(a) the benefit of Korean Patent Application No. 10-2023-0036239 filed on Mar. 21, 2023, the entire contents of which are incorporated herein by reference.

BACKGROUND

The present disclosure relates to a bollard for floor installation, particularly, a bollard for floor installation that can be installed upright on the ground, etc. to be able to absorb or attenuate external shock in all directions.

In general, a forklift vehicle, etc. are used at large warehouses to load/unload and carry product pallets, and load product pallets on shelf racks in multiple stages or unload product pallets from shelf racks. A forklift vehicle has a forklift at the front and carries pallets by inserting forks into the space inside the pallets and then lifts the pallets. Cases in which structures in a warehouse, that is, the vertical posts of shelf racks are impacted due to carelessness of the driver of a forklift vehicle or a pallet, etc. obstructing the front visual field of the driver frequently occur when carrying product pallets using a forklift vehicle.

The structure of a shelf rack may be weakened by such impact and the load of products loaded in multiple stages, and if it repeats, the shelf rack itself collapses, which may result in a large accident. Accordingly, bollards or bollard fences are installed with predetermined intervals on the ground in all directions around shelf racks to prevent impact from being directly applied to the shelf racks. In general, bollards, like a bollard having a pedestrian protection function disclosed in Korean Patent Application No. 10-2021-0160961, are installed by fitting the lower portion of a supporting pipe having a shock absorbing portion in a pipe holder having a lower portion embedded in the ground to be able to prevent local deformation of the supporting pipe and distribute impact in a collision situation, but such bollards are installed and fixed upright on the ground, so there is a limitation in all-direction shock absorption effect.

Accordingly, the present disclosure relates to a bollard for floor installation, that is, a bollard for floor installation manufactured to be installed on the ground but to be able to attenuate external impact in all directions.

SUMMARY OF THE INVENTION

The present disclosure relates to a bollard for floor installation and an objective of the present disclosure is to provide a bollard for floor installation that can absorb sufficiently impact due to collisions that may be generated in all directions.

In order to achieve the objectives, the present disclosure provides a bollard for floor installation that includes: a base that is installed on the ground; an intermediate outer cylinder that is installed on the top of the base; a connector that is fitted in the base through the internal space of the intermediate outer cylinder; a spring that is fitted on the connector; and an extension outer container that extends a length by being coupled to the intermediate outer cylinder.

The present disclosure relates to a bollard for floor installation. When impact is applied to the bollard installed upright on the ground in several directions, the bollard inclines in the application direction of external forces. However, since a spring is installed therein, the bollard can be returned into the initial upright state by elasticity simultaneously with inclining in an external force application direction. Accordingly, it is possible to more effective absorb and attenuate impact, and simultaneously, the connector made of a soft material in the intermediate outer cylinder is compressed or deformed in the collision direction, so it is possible to maximize the impact attenuation effect. Therefore, there is an advantage that it is possible to minimize damage due to an external force and increase the lifespan.

BRIEF DESCRIPTION OF THE DRAWINGS

The above and other objectives, features and other advantages of the present invention will be more clearly understood from the following detailed description when taken in conjunction with the accompanying drawings, in which.

DETAILED DESCRIPTION OF THE INVENTION

Figure 1:
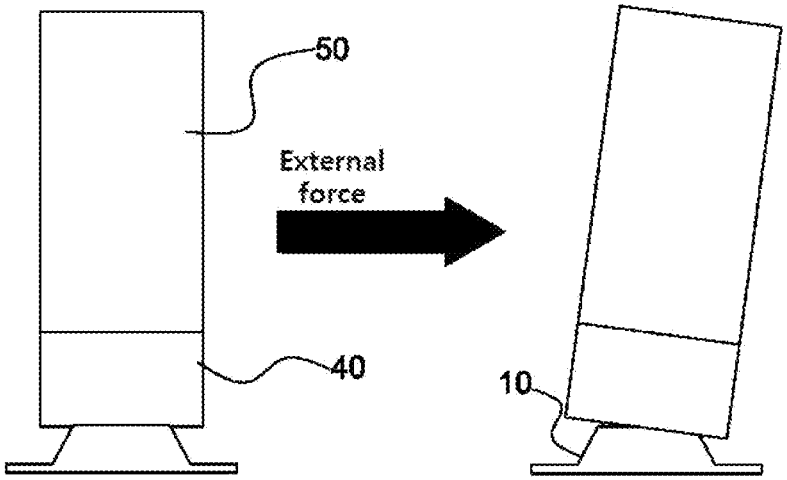
FIG. 1 is a 3D view of the entire of a bollard for floor installation.

Hereafter, the present disclosure is described in detail with reference to the accompanying drawings.

The terms and words used in the present specification and claims should not be interpreted as being limited to typical meanings or dictionary definitions, but should be interpreted as having meanings and concepts relevant to the technical scope of the present disclosure based on the rule according to which an inventor can appropriately define the concept of the terms to describe most appropriately in the best possible way that he or she knows for carrying out the disclosure.

Accordingly, it should be appreciated that there may be various equivalents and modifications that can replace the embodiments and the configurations at the time at which the present application is filed.

The present disclosure relates to a bollard for floor installation that include: a base 10 that is installed on the ground; an intermediate outer cylinder 40 that is installed on the top of the base; a connector 20 that is fitted in the base through the internal space of the intermediate outer cylinder; a spring 30 that is fitted on the connector; and an extension outer container 50 that extends a length by being coupled to the intermediate outer cylinder 50.

In more detail, the base 10 has: a grounding fixing portion 11 that can be installed and fixed on the ground by a fixing member (not shown); and an upright fixing portion 12 that protrudes upward from the top of the ground fixing portion and has an insertion fastening groove 12*a*.

Further, the connector 20 has: an insertion fastening portion 21 that is formed at the lower portion thereof to be fitted in the insertion fastening portion of the base; and a main body 22 that is integrally formed on the top of the insertion fastening portion.

Figure 2:
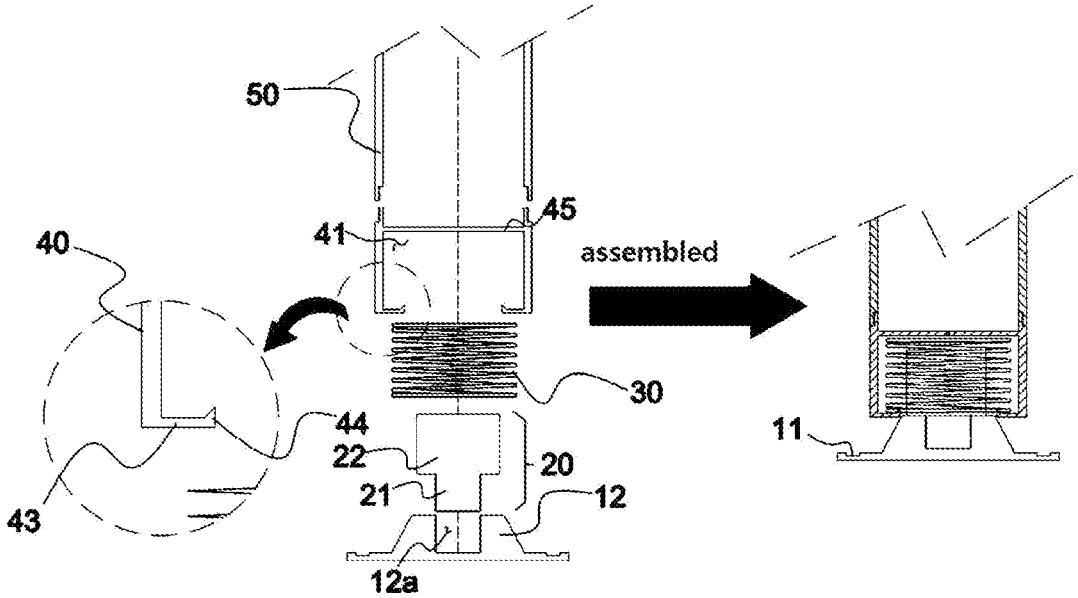
FIGS. 2 and 3 are a detailed exploded cross-sectional view and an assembly view of the bollard for floor installation.
Figure 3:
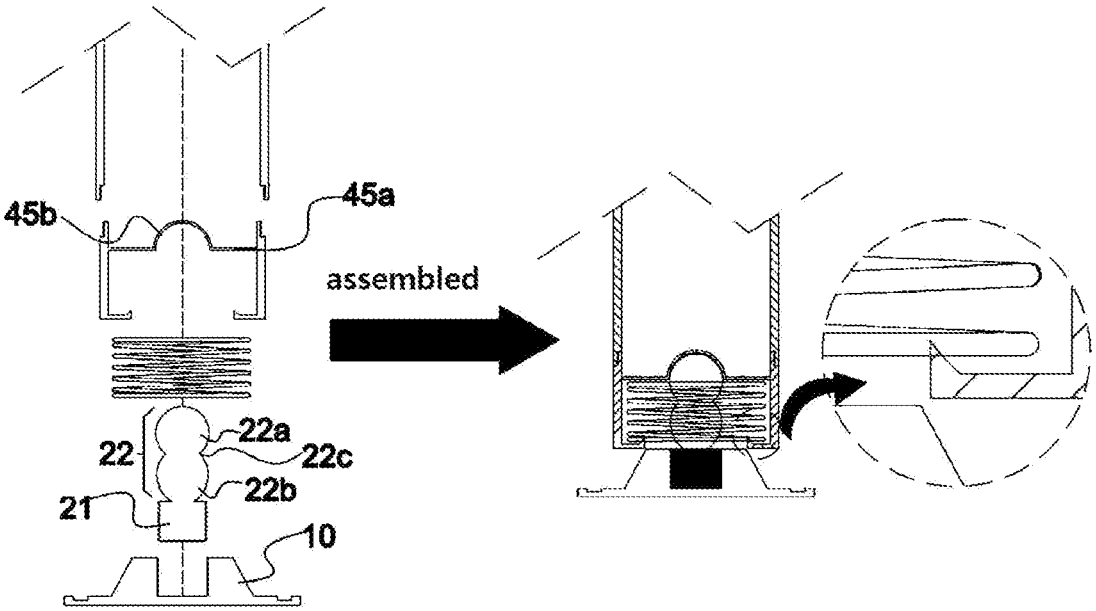
Figure 4:
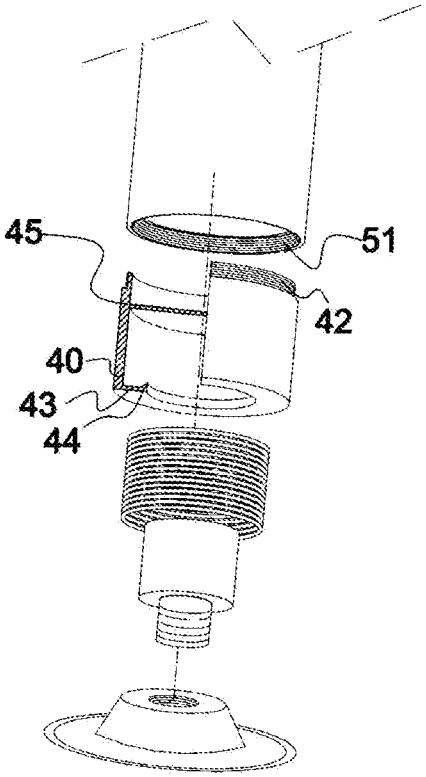
FIGS. 4 and 5 are exploded perspective views of the bollard for floor installation.
Figure 5:
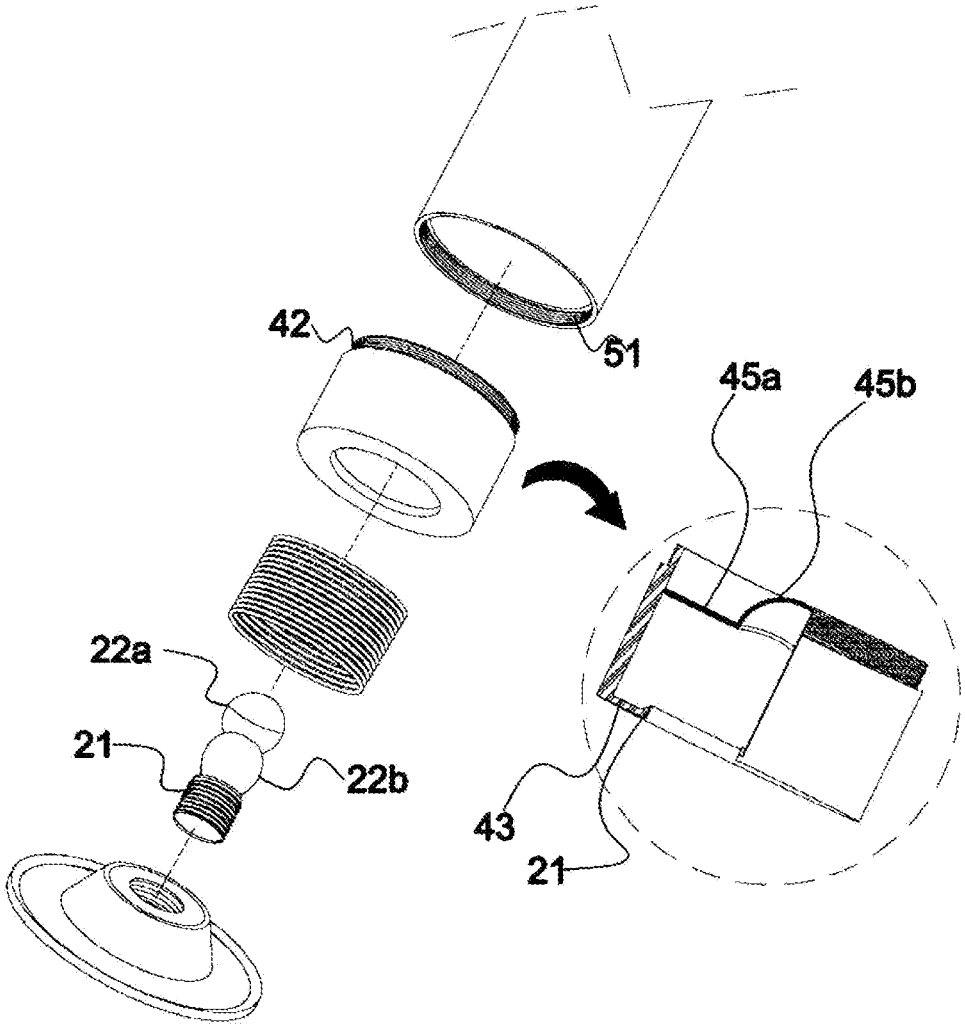

Further, the main body may be formed in a cylindrical shape, as shown in FIG. 2, or an upper ellipsoidal solid 22*a* and a lower ellipsoidal solid 22*b* that are different in outer diameter may be combined while forming a coupling groove 22*c*, as shown in FIG. 3. In more detail, the upper ellipsoidal solid and the lower ellipsoidal solid are combined with each other and the coupling groove 22*c* is formed by the difference in outer diameter, whereby an "8" shape is formed. The lower ellipsoidal solid is not limited to an ellipsoidal solid shape.

Further, the intermediate outer cylinder 40 has: an internal space 41 that is defined therein; a locking supporting plate 43 that protrudes inward perpendicular to the longitudinal direction from the inner wall of the lower end of the intermediate outer cylinder; a spring locking hook 44 that protrudes upward from the end of the locking supporting plate; and a compressive separating portion 45 that is formed at the upper end in the internal space of the intermediate outer cylinder.

Further, the compressive separating portion 45 may be formed in a plate shape to be able to define the internal space, as shown in FIG. 2, or, as shown in FIG. 3, may have: a semispherical separation socket 45*b* at the center thereof; and a compressive separation plate 45*a* formed between the edge of the semispherical separation socket 45*b* and the inner wall of the intermediate outer cylinder.

Further, the extension outer cylinder 50 has a second coupling portion 51 formed at the lower end thereof to be able to be coupled to the first coupling portion 42 of the intermediate outer cylinder.

As an embodiment, the grounding fixing portion 11 of the base 10 is fixed to the ground using a fixing member (not shown) and then the insertion fastening portion 21 of the connector 20 can be inserted and fastened into the insertion fastening groove 12*a* of the upright fixing portion 12 of the base through the internal space 41 of the intermediate outer cylinder 40. Then, the spring 30 is installed outside the main body 22 of the connector 20, the lower end of the spring is fixed by the spring locking hook 44 of the intermediate outer container, and the upper end of the spring is fixed by the compressive separating portion 45. Accordingly, it is possible to prevent the spring from separating out of the internal space 41 of the intermediate outer container. The main body of the connector may be formed in a cylindrical shape, as in FIG. 2, or may be manufactured in an "8" shape. When the main body is formed in a cylindrical shape, the compressive separating portion 45 of the intermediate outer cylinder is formed over the internal space and may be formed in a disc shape along the inner side of the intermediate outer cylinder.

When it is the main body is formed in an "8" shape, the compressive separating portion may be composed of the semispherical separation socket 45*b* at the center thereof and the compressive separation plate 45*a* to be able to define the internal space between the semispherical separation socket and the inner wall of the intermediate outer cylinder, and the upper ellipsoidal solid 22*a* of the connector is inserted in the semispherical separation socket and operates like a hip joint when an external force is applied.

Further, the spring locking hook 44 protruding upward from the end of the locking supporting plate 43 of the intermediate outer cylinder can fix the lower end of the spring in cooperation with the locking supporting plate.

Further, since the first coupling portion 42 is formed at the upper end of the intermediate outer cylinder 40 and the second coupling portion 51 is formed at the lower end of the extension outer cylinder 50, it is possible to extend the height by coupling the extension outer cylinder 50 to the intermediate outer cylinder.

Figure 6:
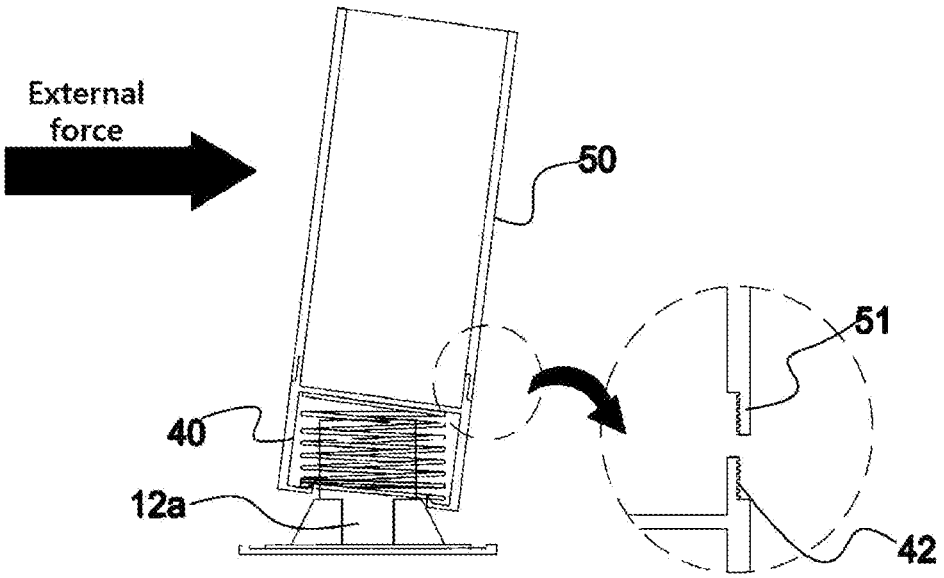
FIGS. 6 and 7 are cross-sectional views showing the practical use of the bollard for floor installation.

When an external force is applied to the intermediate outer cylinder 40 or the extension outer cylinder 50 from the left, the bollard may incline, as shown in FIG. 1. In this case, when the connector is formed in a cylindrical shape, as shown in FIG. 6, the left lower end of the spring is compressed upward by the spring supporting plate and the spring locking hook of the intermediate outer cylinder and simultaneously the right upper end of the spring is compressed downward by the compressive separating portion at the upper portion of the intermediate outer cylinder, whereby it is possible to attenuate and absorb impact, and when the external force is removed, bollard is returned by the elasticity of the spring.

Figure 7:
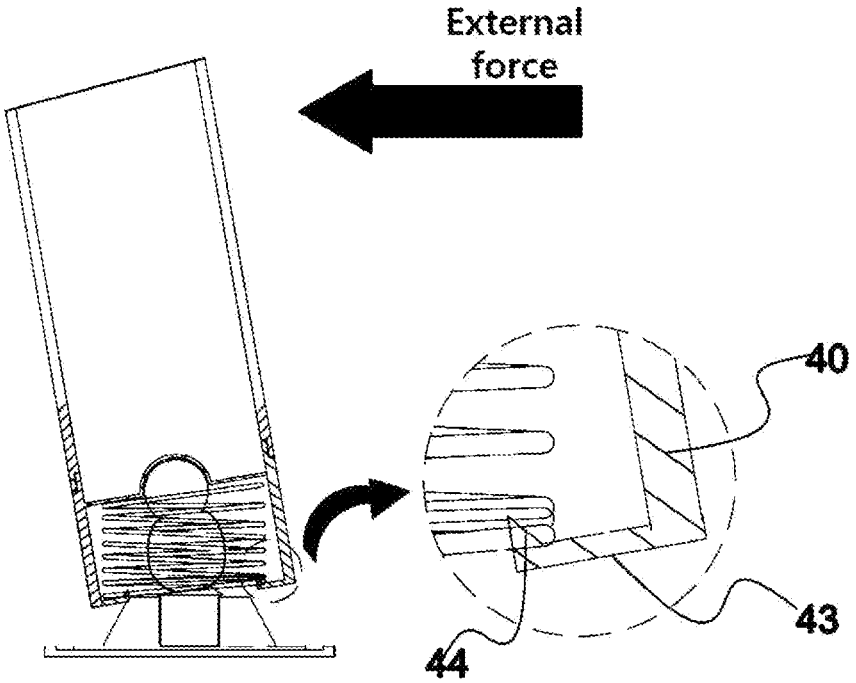

Further, when the main body is formed in an "8" shape, as shown in FIG. 7, and when an external force is applied from the right, the right lower end of the spring is compressed upward by the spring supporting plate and the spring locking hook of the intermediate outer cylinder and simultaneously the left upper end of spring is compressed downward by the compressive separating portion at the upper portion of the intermediate outer cylinder, whereby it is possible to attenuate and absorb impact. Further, since the upper ellipsoidal solid is inserted in the semispherical separation socket and operates like a hip joint, it is possible to secure a firm operation of the intermediate outer cylinder when an external force is applied, and the bollard is returned by the elasticity of the spring when the external force is removed.

Further, when the main body is formed in an "8" shape, the upper ellipsoidal solid and the lower ellipsoidal solid can be flexibly deformed around the coupling groove 22*c* when an external force is applied, so it is possible to more effectively absorb and attenuate impact.

Hereinabove, although the present disclosure is described by specific matters such as concrete components, and the like, embodiments, and drawings, they are provided only for assisting in the entire understanding of the present disclosure. Therefore, the present disclosure is not limited to the embodiments. Various modifications and changes may be made by those skilled in the art to which the present disclosure pertains from this description.

Therefore, the spirit of the present disclosure should not be limited to the described embodiments, and the following claims as well as all modified equally or equivalently to the claims are intended to fall within the disclosure.

What is claimed is:

1. A bollard for floor installation, comprising:

a base that is installed on the ground;

an intermediate outer cylinder that is installed on a top of the base, has a compressive separating portion formed over an internal space thereof, and has a locking supporting plate at a lower portion thereof and a spring locking hook at an end of the locking supporting plate;

a connector that is fitted in the base through the internal space of the intermediate outer cylinder;

a spring that is fitted on the connector; and an extension outer cylinder that extends a length by being coupled to the intermediate outer cylinder, wherein the base comprises: a grounding fixing portion that can be installed and fixed on the ground by a fixing member; and an upright fixing portion that protrudes upward from a top of the ground fixing portion and has an insertion fastening groove, and the connector comprises: an insertion fastening portion that is formed at a lower portion thereof to be fitted in an insertion fastening portion of the base; and a main body that is integrally formed on a top of the insertion fastening portion, wherein the main body is formed in an "8" shape by combining an upper ellipsoidal solid and a lower ellipsoidal solid, which are different in outer diameter, with a coupling groove therebetween.

2. The bollard of claim 1, wherein the main body may be manufactured in a cylindrical shape.

3. The bollard of claim 1, wherein the compressive separating portion may comprise: a semispherical separation socket at a center thereof; and a compressive separation plate formed between an edge of the semispherical separation socket and an inner wall of the intermediate outer cylinder, so the upper ellipsoidal solid can be inserted in the semispherical separation socket and operated when an external force is applied.

4. The bollard of claim 1, further comprising:

a first coupling portion formed at an upper end of the intermediate outer cylinder; and a second coupling portion formed at a lower end of the extension outer cylinder, so the intermediate outer cylinder and the extension outer cylinder can be fastened to each other.

* * * * *